US009765997B2

(12) United States Patent
Nakashima et al.

(10) Patent No.: US 9,765,997 B2
(45) Date of Patent: Sep. 19, 2017

(54) AIR CONDITIONING APPARATUS

(75) Inventors: Ken Nakashima, Kawasaki (JP); Hideya Tamura, Kawasaki (JP); Takahiro Matsunaga, Kawasaki (JP); Shinju Watanabe, Kawasaki (JP); Keito Kawai, Kawasaki (JP); Kotaro Toya, Kawasaki (JP); Yasuhiro Oka, Kawasaki (JP)

(73) Assignee: Fujitsu General Limited, Kawasaki-shi (JP)

( * ) Notice: Subject to any disclaimer, the term of this patent is extended or adjusted under 35 U.S.C. 154(b) by 874 days.

(21) Appl. No.: 13/553,375

(22) Filed: Jul. 19, 2012

(65) Prior Publication Data

US 2013/0019622 A1 Jan. 24, 2013

(30) Foreign Application Priority Data

Jul. 22, 2011 (JP) ..... 2011-160463

(51) Int. Cl.
*F25D 29/00* (2006.01)
*F25B 45/00* (2006.01)
(Continued)

(52) U.S. Cl.
CPC ..... *F25B 13/00* (2013.01); *F25B 6/02* (2013.01); *F25B 49/027* (2013.01);
(Continued)

(58) Field of Classification Search
CPC ..... F25B 13/00; F25B 1/10; F25B 2313/008; F25B 2500/19; F25B 2600/2511;
(Continued)

(56) References Cited

U.S. PATENT DOCUMENTS 3,759,321 A * 9/1973 Ares ..... F24F 1/06 165/125
4,554,968 A * 11/1985 Haas ..... F25B 39/02 165/125

(Continued)

FOREIGN PATENT DOCUMENTS

| | | | |
|---|---|---|---|
| JP | 05-099525 A | | 4/1993 |
| JP | 05099525 A | * | 4/1993 |
| JP | 05-172429 A | | 7/1993 |
| JP | 2004-003691 A | | 1/2004 |
| JP | 2004003691 A | * | 1/2004 |
| JP | 2008116145 A | * | 5/2008 |

OTHER PUBLICATIONS

Extended European Search Report in European Patent Application No. 12177323.8-1602, dated Sep. 9, 2013.

*Primary Examiner* — Frantz Jules
*Assistant Examiner* — Meraj A Shaikh
(74) *Attorney, Agent, or Firm* — Venable LLP; Michael A. Sartori; Laura G. Remus

(57) ABSTRACT

A CPU 110 compares the extracted outside air temperature with a first low pressure saturation temperature. When the outside air temperature is lower than the first low pressure saturation temperature, the CPU 110 switches a first three-way valve 22 and a second three-way valve 23 so that a second outdoor heat exchanger 25 is used as a condenser and that a first outdoor heat exchanger 24 is not used. When the outside air temperature is higher than a second low pressure saturation temperature which is the first low pressure saturation temperature to which a predetermined temperature is added, the CPU 110 switches the first three-way valve 22 and the second three-way valve 23 so that the first outdoor heat exchanger 24 is used as a condenser and that the second outdoor heat exchanger 25 is not used.

12 Claims, 6 Drawing Sheets

(51) Int. Cl.

| | |
|---|---|
| ***F25B 49/02*** | (2006.01) |
| ***F24F 1/18*** | (2011.01) |
| ***F24F 11/02*** | (2006.01) |
| ***F25B 13/00*** | (2006.01) |
| ***F25B 6/02*** | (2006.01) |

(52) U.S. Cl.
CPC . *F25B 2313/025* (2013.01); *F25B 2313/0233* (2013.01); *F25B 2313/0294* (2013.01); *F25B 2313/02732* (2013.01); *F25B 2313/0314* (2013.01); *F25B 2700/2106* (2013.01)

(58) Field of Classification Search
CPC ..... F25B 5/00; F25B 2313/025; F24F 3/1429; F24F 3/065; F25D 2700/12; F25D 29/00; B01D 53/265; Y02B 30/743; Y02B 40/32
USPC ..... 62/160, 12, 498, 129, 126, 115, 181; 700/275, 276, 277, 278, 291, 299, 300, 700/282
See application file for complete search history.

(56) References Cited

U.S. PATENT DOCUMENTS

| | | | | |
|---|---|---|---|---|
| 5,277,034 | A * | 1/1994 | Hojo | F24F 3/065 165/228 |
| 2006/0288716 | A1* | 12/2006 | Knight | F25B 49/027 62/196.4 |
| 2009/0084131 | A1* | 4/2009 | Reifel | F24F 1/18 62/515 |
| 2010/0100243 | A1* | 4/2010 | Lee | F25D 29/00 700/275 |
| 2011/0192182 | A1* | 8/2011 | Noda | B01D 53/261 62/160 |
| 2011/0308267 | A1* | 12/2011 | Tamaki | F25B 45/00 62/222 |
| 2013/0199224 | A1* | 8/2013 | Kato | F25B 49/02 62/159 |

* cited by examiner

AIR CONDITIONING APPARATUS

CROSS-REFERENCE TO RELATED APPLICATIONS

The present application claims the benefit of priority of Japanese Patent Application No. 2011-160463, filed on Jul. 22, 2011, which is incorporated herein by reference.

BACKGROUND

Field of the Invention

The present invention relates to an air-conditioning apparatus in which a plurality of indoor units are connected in parallel to one outdoor unit by refrigerant pipes, and more specifically, to an air-conditioning apparatus in which outdoor heat exchangers are efficiently used while the refrigerant circulation amount is prevented from being insufficient when the cooling operation is performed under a condition where the outside air temperature is low.

Related Art

Conventionally, a so-called cooling and heating free air-conditioning apparatus is known in which a plurality of indoor units are connected in parallel to one outdoor unit by refrigerant pipes and each indoor unit can selectively perform a cooling operation and a heating operation. In this air-conditioning apparatus, for example, a plurality of indoor units are placed in different rooms, and it is possible to perform the cooling operation by an indoor unit while performing the heating operation by another indoor unit.

In this type of air-conditioning apparatus, the following are alternately connected by refrigerant pipes such as high pressure gas pipes, low pressure gas pipes and fluid pipes: an outdoor unit having a compressor, an outdoor heat exchanger, a flow path switching valve such as a three-way valve or a four-way valve, and an outdoor expansion valve; a plurality of indoor units having an indoor heat exchanger and an indoor expansion valve; and a plurality of flow dividing units provided so as to correspond to the indoor units and switching the flow direction of the refrigerant flowing in the indoor units.

In such an air-conditioning apparatus, when all the indoor units are performing the cooling operation or when the load required by the indoor units performing the cooling operation is heavier than that required by the indoor units performing the heating operation, the outdoor heat exchanger is used as a condenser. When all the indoor units are performing the heating operation or when the load required by the indoor units performing the heating operation is heavier than that required by the indoor units performing the cooling operation, the outdoor heat exchanger is used as an evaporator.

In an office building, a commercial facility or the like where such an air-conditioning apparatus is installed, when there are rooms in which an apparatus generating heat is placed such as a server room where a computer server is placed and a test room where a test apparatus generating a large amount of heat is placed, the indoor units placed in these rooms perform the cooling operation irrespective of the season to maintain the room temperature at a predetermined temperature, thereby preventing the apparatus generating heat from being adversely affected by the high temperature.

However, in winter, when the outdoor heat exchanger is used as a condenser under a condition where the outside air temperature is extremely low, for example, equal to or lower than −10 degrees C., there is a possibility that the heat exchange between the refrigerant and the outside air at the outdoor heat exchanger is performed more than necessary to reduce the pressure of the refrigerant sent to the indoor units. If the pressure of the refrigerant is reduced, the refrigerant circulation amount in the refrigerant circuit of the air-conditioning apparatus is reduced, so that there is a possibility that the evaporating pressure at the indoor heat exchangers of the indoor units performing the cooling operation is reduced to reduce cooling ability.

To solve such a problem, an air-conditioning apparatus has been proposed in which the outdoor heat exchanger of the outdoor unit is divided into a plurality of units, an outdoor expansion valve is connected to each unit and the number of outdoor heat exchangers used is determined according to the detected outside air temperature and refrigerant temperature (for example, refer to JP-A-2004-3691 (pages 4 to 6, FIG. 1)). In this air-conditioning apparatus, when the outdoor heat exchangers are used as condensers under a condition where the outside air temperature is extremely low, by fully closing the outdoor expansion valves connected to the outdoor heat exchangers other than the outdoor heat exchangers used, the outdoor heat exchangers corresponding to the fully closed outdoor expansion valves are made unused to thereby reduce the number of outdoor heat exchangers used. By doing this, the heat exchange between the refrigerant and the outside air at the outdoor heat exchangers can be prevented from being performed more than necessary to reduce the pressure of the refrigerant sent to the indoor units, so that the evaporating pressure at the indoor heat exchangers of the indoor units performing the cooling operation can be prevented from being reduced by the reduction in refrigerant circulation amount to reduce the cooling ability.

SUMMARY

Normally, in the air-conditioning apparatus as in JP-A-2004-3691, when the cooling operation is performed while the number of outdoor heat exchangers used is reduced, predetermined one or more than one of a plurality of outdoor heat exchangers is used as a condenser. In that case, as the outdoor heat exchanger used, in order to increase the heat exchange efficiency as much as possible, an outdoor heat exchanger is frequently used that is disposed in the vicinity of an outdoor fan where the amount of passage of the outside air taken into the outdoor unit is largest. However, when the outdoor heat exchangers are selectively used as described above, there is a possibility that the refrigerant existing in the outdoor heat exchangers which are not used is condensed into a fluid refrigerant and this fluid refrigerant accumulates in the unused outdoor heat exchangers. Consequently, there is a problem in that the refrigerant circulation amount in the refrigerant circuit is insufficient and this reduces the cooling ability.

One or more embodiments of the present invention provides an air-conditioning apparatus in which when some of a plurality of outdoor heat exchangers mounted in one outdoor unit are caused to function as condensers under a condition where the outside air temperature is low, the refrigerant circulation amount in the refrigerant circuit can be prevented from being insufficient, and the heat exchange efficiency can be improved.

According to one or more embodiments of the present invention, an air-conditioning apparatus is provided with: an outdoor unit including a compressor, a plurality of outdoor heat exchangers, flow path switching means connected to one end of each of the outdoor heat exchangers and switching connection to a refrigerant outlet or a refrigerant inlet of the compressor, opening and closing means connected to another end of each of the outdoor heat exchangers, an outdoor fan, and outside air temperature detecting means for detecting an outside air temperature; a plurality of indoor units including an indoor heat exchanger and refrigerant temperature detecting means for detecting a temperature of a refrigerant flowing into or flowing out from the indoor heat exchanger; and control means for controlling the outdoor unit and the indoor units. The outdoor fan is disposed in an upper part of a housing of the outdoor unit, and the housing of the outdoor unit has an inlet for taking outside air into the housing by a rotation of the outdoor fan. Moreover, the outdoor heat exchangers are disposed one above another so as to face the inlet. The control means acquires the outside air temperature detected by the outside air temperature detecting means, and acquires, as a first low pressure saturation temperature, the refrigerant temperature detected by the refrigerant temperature detecting means corresponding to the indoor heat exchanger used as an evaporator. The control means causes the outdoor heat exchangers to function as condensers, and in a case where some of the outdoor heat exchangers are selectively used, when the outside air temperature is lower than the first low pressure saturation temperature, the control means selects for use the outdoor heat exchanger disposed below, and when the outside air temperature is higher than the first low pressure saturation temperature, the control means selects for use the outdoor heat exchanger disposed above.

According to one or more embodiments of the present invention as described above, when the outdoor heat exchangers are caused to function as condensers and some of a plurality of outdoor heat exchangers are selectively used, the outdoor heat exchangers to be used are selected according to the relationship between the acquired outside air temperature and the first low pressure saturation temperature. Thereby, the fluid refrigerant is prevented from accumulating in the unused outdoor heat exchangers and this prevents the reduction in the refrigerant circulation amount in the refrigerant circuit including the outdoor heat exchangers used, and by using the outdoor heat exchanger near the outdoor fan as much as possible, the heat exchange efficiency at the outdoor heat exchangers can be improved.

DETAILED DESCRIPTION

Hereinafter, an embodiment of the present invention will be described in detail based on the attached drawings. As the embodiment, an air-conditioning apparatus will be described as an example in which five indoor units are connected in parallel to one outdoor unit having two outdoor heat exchangers and a so-called cooling and heating free operation can be performed in which each indoor unit can selectively perform the cooling operation and the heating operation. The present invention is not limited to the embodiment described below and may be variously modified without departing from the gist of the present invention.

Embodiment

Figure 1:
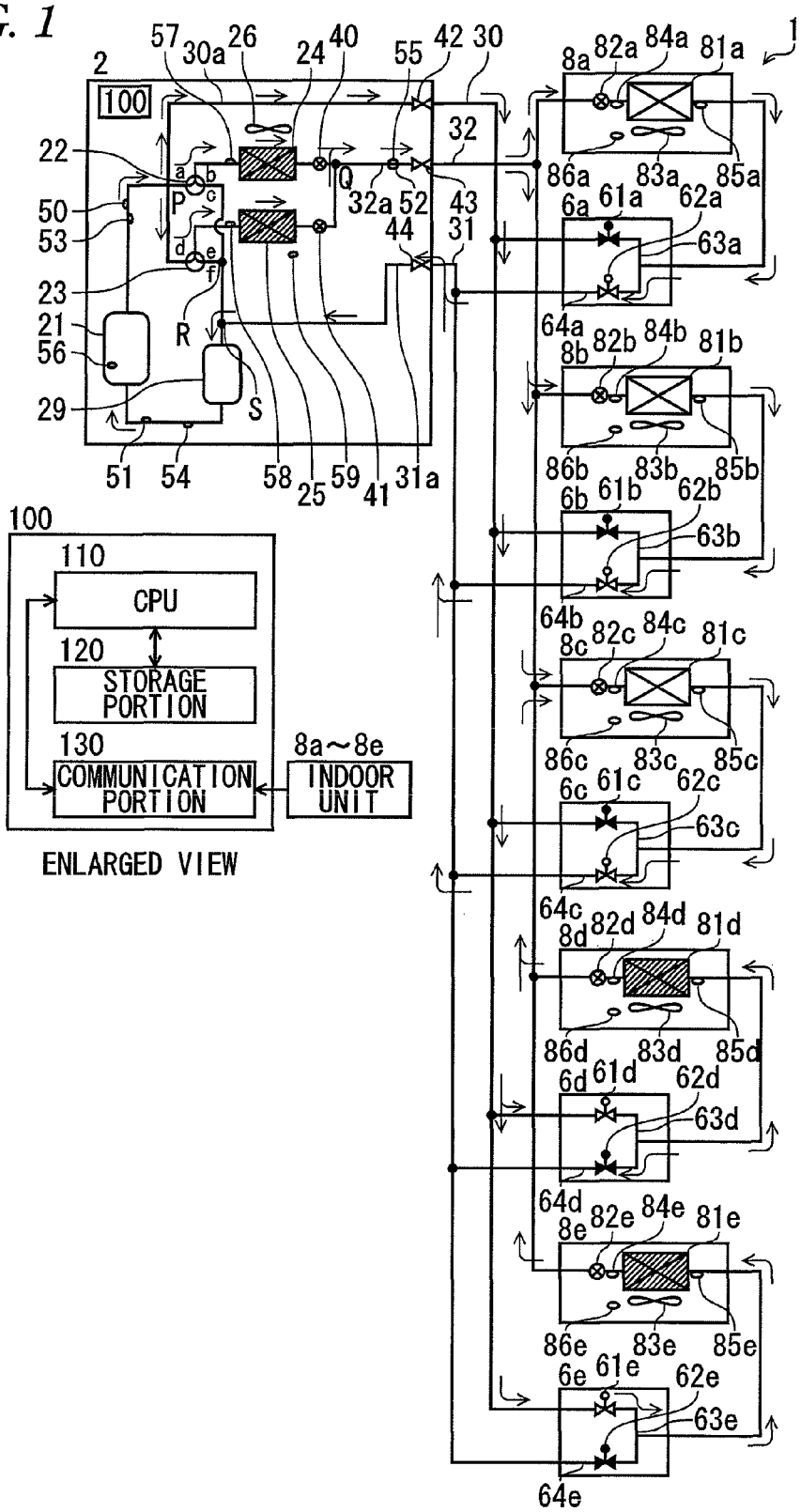
FIG. 1 is a refrigerant circuit diagram, of an air-conditioning apparatus as an embodiment of the present invention, explaining the flow of the refrigerant when a cooling dominant operation is performed.

As shown in FIG. 1, an air-conditioning apparatus 1 in the present embodiment is provided with one outdoor unit 2, five indoor units 8*a* to 8*e*, five flow dividing units 6*a* to 6*e*, a high pressure gas pipe 30 as a first refrigerant pipe, a low pressure gas pipe 31, a fluid pipe 32 as a second refrigerant pipe, and a controller 100. The outdoor unit 2, the indoor units 8*a* to 8*e* and the flow dividing units 6*a* to 6*e* are alternately connected by the high pressure gas pipe 30, the low pressure gas pipe 31 and the fluid pipe 32 to thereby form a refrigerant circuit of the air-conditioning apparatus 1.

In this air-conditioning apparatus 1, various operations can be performed according to the open/closed condition of various valves provided in the outdoor unit 2 and the flow dividing units 6*a* to 6*e*. In the description given below, as an example, a case will be described where of the operations, a cooling dominant operation is performed in which the indoor units 8*a* to 8*c* perform the cooling operation, the indoor units 8*d* and 8*e* perform the heating operation and the load required by the indoor units 8*a* to 8*c* performing the cooling operation is heavier than that required by the indoor units 8*d* and 8*e* performing the heating operation.

Figure 2A:
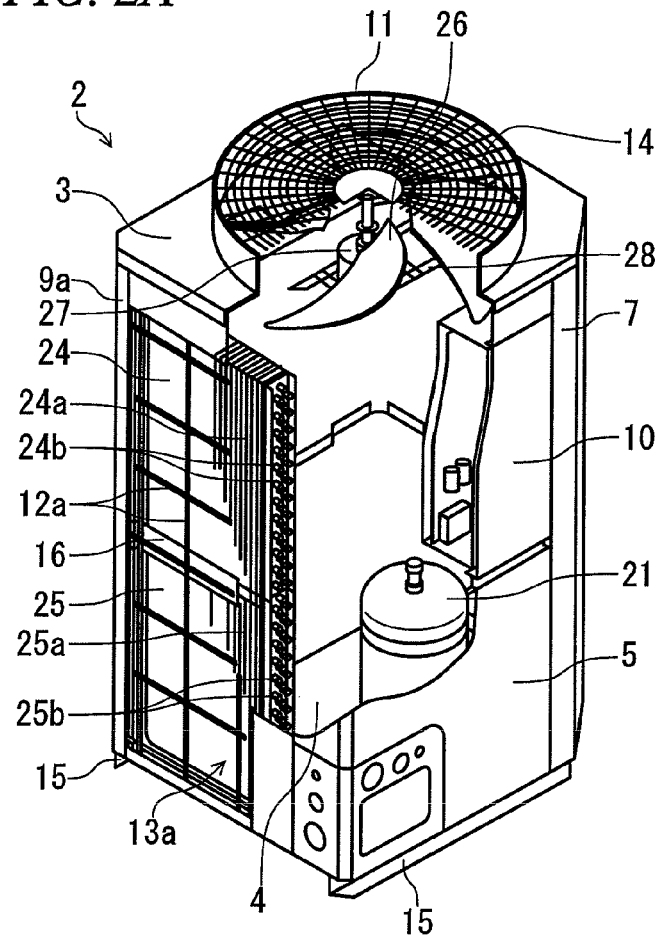
FIGS. 2A and 2B are schematic views of an outdoor unit in the air-conditioning apparatus as the embodiment of the present invention.
Figure 2B:
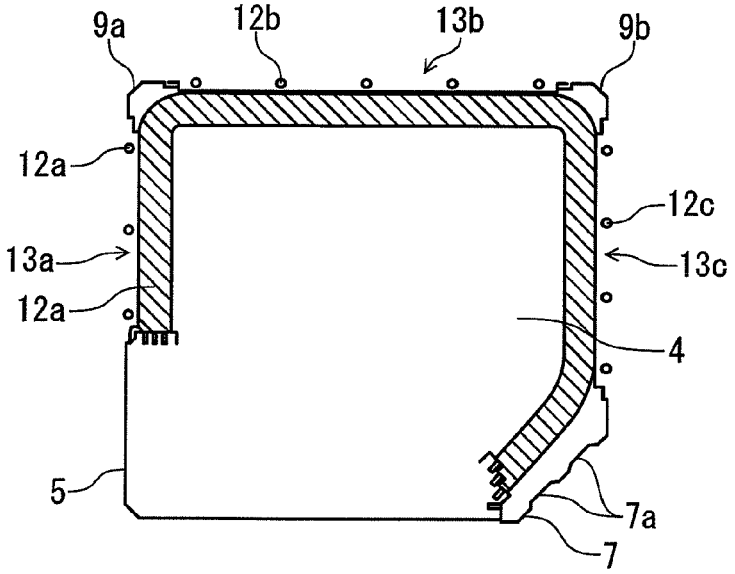

FIG. 1 is a refrigerant circuit diagram when the cooling dominant operation is performed. FIGS. 2A and 2B are explanatory views of the outdoor unit of the present embodiment. As shown in FIGS. 1, 2A and 2B, the outdoor unit 2 is mainly provided with: an electric component box 10 made of a sheet metal formed into a box shape, and accommodating boards such as a control board and a power source board; a compressor 21; a first three-way valve 22 and a second three-way valve 23 as the flow path switching means; a first outdoor heat exchanger 24; a second outdoor heat exchanger 25; an outdoor fan 26; a fan motor 27 the output shaft of which is connected to the outdoor fan 26 to rotate the outdoor fan 26; an accumulator 29; a first outdoor expansion valve 40 and a second outdoor expansion valve 41 as the opening and closing means for opening and closing the refrigerant pipes connected to the first outdoor heat exchanger 24 and the second outdoor heat exchanger 25; and closing valves 42 to 44. These devices constituting the outdoor unit 2 are provided inside the housing of the outdoor unit 2 formed of a top plate 3, a bottom plate 4, a front panel 5, a front side pillar 7, a left side pillar 9*a*, a right side pillar 9*b* and a fan guard 11.

As shown in FIGS. 2A and 2B, the front panel 5 is a steel plate that is bent from the front face to the left face of the outdoor unit 2 substantially in an L shape when viewed from the top face, and is disposed so as to cover most part of the front face and part of the front side of the left face of the housing of the outdoor unit 2. The front side pillar 7 is, as shown in FIG. 2B, made of a steel plate having a grille 7*a* for taking outside air into the outdoor unit 2, has both end portions thereof bent a predetermined angle (obtuse angle), and is disposed so that the bent portions cover part of the front face and part of the front side of the right face of the housing of the outdoor unit 2. The left side pillar 9*a* and the right side pillar 9*b* have substantially the same shape, and are steel plates processed so as to be substantially L-shaped in cross section. The left side pillar 9*a* is disposed at the left angular part on the back side of the bottom plate 4, and the right side pillar 9*b* is disposed at the right angular part on the back side of the bottom plate 4.

As shown in FIG. 2B, on the left side of the housing of the outdoor unit 2, a part between the side end of the front panel 5 and the left side pillar 9*a* is opened as an inlet 13*a* for taking outside air into the outdoor unit 2, and a protecting member 12*a* is provided at the inlet 13*a*. On the back side of the housing of the outdoor unit 2, a part between the left side pillar 9*a* and the right side pillar 9*b* is opened as an inlet 13*b* for taking outside air into the outdoor unit 2, and a protecting member 12*b* is provided at the inlet 13*b*. On the right side of the housing of the outdoor unit 2, a part between the front side pillar 7 and the right side pillar 9*b* is opened as an inlet 13*c* for taking outside air into the outdoor unit 2, and a protecting member 12*c* is provided at the inlet 13*c*. In the inlets 13*a* to 13*c*, the parts of the first outdoor heat exchanger 24 and the second outdoor heat exchanger 25 corresponding to the inlets are exposed.

The top plate 3 is a substantially quadrilateral steel plate, and the peripheral part thereof is substantially orthogonally bent downward into a flange. The top plate 3 is screwed to the upper ends of the front panel 5, the front side pillar 7, the left side pillar 9*a* and the right side pillar 9*b*. On the top plate 3, in a position corresponding to the outdoor fan 26 disposed in an upper part of the housing, a circular opening is formed, and the peripheral part thereof is substantially orthogonally bent upward as an outlet 11 for discharging to the outside the outside air sucked into the outdoor unit 2 by the outdoor fan 26. At the upper end of the outlet 11, a fan guard 14 is provided so as to cover the upper end of the outlet 11. The fan motor 27 is fixed to the upper end of the first outdoor heat exchanger 24 by a metal fixing bracket 28.

The bottom plate 4 is a substantially quadrilateral steel plate, and the peripheral part thereof is substantially orthogonally bent upward into a flange. The bottom plate 4 is screwed to the lower ends of the front panel 5, the front side pillar 7, the left side pillar 9*a* and the right side pillar 9*b*. On the bottom face of the bottom plate 4, a leg 15 extending in the horizontal direction of the outdoor unit 2 for placing the outdoor unit 2 on the ground, the roof or the like is provided at each of the front and the back.

The compressor 21 is an ability variable compressor the operation capacity of which can be varied by being driven by a non-illustrated motor the number of rotations of which is controlled by an inverter, and is fixed to the bottom plate 4. As shown in FIG. 1, the discharge side of the compressor 21 is connected to the closing valve 42 by an outdoor unit high pressure gas pipe 30*a*, and pipes having branched off from the outdoor unit high pressure gas pipe 30*a* at a connection point P are connected to the first three-way valve 22 and the second three-way valve 23. The sucking side of the compressor 21 is connected to the outflow side of the accumulator 29 by a refrigerant pipe. The inflow side of the accumulator 29 is connected to the closing valve 44 by an outdoor unit low pressure gas pipe 31*a*. The accumulator 29 separates the inflowing refrigerant into a gas refrigerant and a fluid refrigerant, and allows only the gas refrigerant to be sucked into the compressor 21.

The first three-way valve 22 and the second three-way valve 23 are valves for switching the direction of the flow of the refrigerant. The first three-way valve 22 has three ports a to c, and the second three-way valve 23 has three ports d to f. In the first three-way valve 22, the refrigerant pipe connected to the port a and the refrigerant pipe connected to the discharge side of the compressor 21 are connected at the connection point P. The port b and the first outdoor heat exchanger 24 are connected by a refrigerant pipe, and the refrigerant pipe connected to the port c is connected to the outdoor unit low pressure gas pipe 31*a* at a connection point S.

In the second three-way valve 23, the refrigerant pipe connected to the port d is connected to the connection point P. The port e and the second outdoor heat exchanger 25 are connected by a refrigerant pipe, and the refrigerant pipe connected to the port f is connected to the refrigerant pipe connecting the port c of the first three-way valve 22 and the connection point S, at a connection point R.

As shown in FIG. 2B, the first outdoor heat exchanger 24 and the second outdoor heat exchanger 25 are formed substantially in a U shape when viewed from the top face, and are disposed so that surfaces thereof face the inlets 13*a* to 13*c* of the outdoor unit 2. The right side ends of the first outdoor heat exchanger 24 and the second outdoor heat exchanger 25 are bent along the surface of the front side pillar 7 where the grille 7*a* is provided. The second outdoor heat exchanger 25 is fixed to the bottom plate 4, and the lower end of the first outdoor heat exchanger 24 is fixed to the upper end of the second outdoor heat exchanger 25 through a metal fixing bracket 16, whereby the first outdoor heat exchanger 24 and the second outdoor heat exchanger 25 are disposed one above the other.

The first outdoor heat exchanger 24 includes a multiplicity of fans 24*a* made of an aluminum member and a plurality of copper pipes 24*b* made of a copper member and through which the refrigerant is circulated. One ends of the copper pipes 24*b* are connected to the port b of the first three-way valve 22 through a refrigerant pipe, and the other ends of the copper pipes 24*b* are connected to one end of the first outdoor expansion valve 40 through a refrigerant pipe. The other end of the first outdoor expansion valve 40 is connected to the closing valve 43 by an outdoor unit fluid pipe 32*a*.

The second outdoor heat exchanger 25 includes a multiplicity of fins 25*a* made of an aluminum member, and a plurality of copper pipes 25*b* made of a copper member and through which the refrigerant is circulated. One ends of the copper pipes 25*b* are connected to the port e of the second three-way valve 23 through a refrigerant pipe, and the other ends of the copper pipes 25*b* are connected to one end of the second outdoor expansion valve 41 through a refrigerant pipe. The other end of the second outdoor expansion valve 41 is connected to the outdoor unit fluid pipe 32*a* by a refrigerant pipe at a connection point Q.

In addition to the above-described structure, various sensors are provided in the outdoor unit 2. As shown in FIG. 1, a high pressure sensor 50 that detects the pressure of the refrigerant discharged from the compressor 21 and a discharge temperature sensor 53 that detects the temperature of the refrigerant discharged from the compressor 21 are provided between the discharge side of the compressor 21 and the connection point P on the outdoor unit high pressure gas pipe 30*a*. A low pressure sensor 51 that detects the pressure of the refrigerant sucked into the compressor 21 and a sucking temperature sensor 54 that detects the temperature of the refrigerant sucked into the compressor 21 are provided between the sucking side of the compressor 21 and the connection point S on the outdoor unit low pressure gas pipe 31*a*. An intermediate pressure sensor 52 that detects the pressure of the refrigerant flowing through the outdoor unit fluid pipe 32*a* and a refrigerant temperature sensor 55 that detects the temperature of the refrigerant flowing through the outdoor unit fluid pipe 32*a* are provided between the connection point Q and the closing valve 43 on the outdoor unit fluid pipe 32*a*.

On the pipe connecting the port b of the first three-way valve 22 and the first outdoor heat exchanger 24, a first heat exchange temperature sensor 57 is provided that detects the temperature of the refrigerant flowing out from the first outdoor heat exchanger 24 or flowing into the first outdoor heat exchanger 24. On the pipe connecting the port e of the second three-way valve 23 and the second outdoor heat exchanger 25, a second heat exchange temperature sensor 58 is provided that detects the temperature of the refrigerant flowing out from the second outdoor heat exchanger 25 or flowing into the second outdoor heat exchanger 25. On the outer surface of an air tight container of the compressor 21, a compressor temperature sensor 56 is provided that detects the temperature of the compressor 21. In the vicinity of the inlet 13 of the outdoor unit 2, an outside air temperature sensor 59 is provided as the outside air temperature detecting means for detecting the temperature of the outside air flowing into the outdoor unit 2, that is, the outside air temperature.

Moreover, the outdoor unit 2 is provided with the controller 100. The controller 100 is mounted on a non-illustrated control board accommodated in the electric component box 10, and is provided with a CPU 110, a storage portion 120 and a communication portion 130. The CPU 110 acquires the detection signals from the above-described sensors of the outdoor unit 2, and acquires the control signals outputted from the indoor units 8*a* to 8*e* through the communication portion 130. The CPU 110 performs various control operations such as switching of the compressor 21, the first three-way valve 22 and the second three-way valve 23, rotation of the fan motor 27 and adjustment of the openings of the first outdoor expansion valve 40 and the second outdoor expansion valve 41 based on the acquired detection signals and control signals.

The storage portion 120 is formed of a ROM or a RAM, and stores the control programs of the outdoor unit 2 and the detection values corresponding to the detection signals from the sensors. The communication portion 130 is an interface performing communication between the outdoor unit 2 and the indoor units 8*a* to 8*e*. The electric component box 10 accommodating the controller 100 is placed, as shown in FIG. 2A, in an upper part of the front side of the housing of the outdoor unit 2 (substantially flush with the first outdoor heat exchanger 24).

FIG. 1 is a refrigerant circuit diagram when the air-conditioning apparatus 1 performs the cooling dominant operation as mentioned above, and in this case, the CPU 110 of the outdoor unit 2 makes switching so that the port a and the port b of the first three-way valve 22 communicate and that the port d and port e of the second three-way valve 23 communicate, thereby causing the first outdoor heat exchanger 24 and the second outdoor heat exchanger 25 to function as condensers.

At this time, the first outdoor expansion valve 40 and the second outdoor expansion valve 41 have the openings thereof controlled by the CPU 110 according to the operation condition. For example, in the cooling operation, they are fully opened by the CPU 110, and in the heating operation, the openings are adjusted by the CPU 110 according to the difference between the discharge pressure of the compressor 21 detected by the high pressure sensor 50 and the fluid pressure detected by the intermediate pressure sensor 52. In FIG. 1, the parts between the communicating ports of the first three-way valve 22 and the second three-way valve 23 are shown by solid lines, and the parts between the noncommunicating ports thereof are shown by broken lines.

The five indoor units 8*a* to 8*e* are provided with indoor heat exchangers 81*a* to 81*e*, indoor expansion valves 82*a* to 82*e* and indoor fans 83*a* to 83*e*. Since the structures of the indoor units 8*a* to 8*e* are all the same, in the description given below, only the structure of the indoor unit 8*a* will be described, and descriptions of the other indoor units 8*b* to 8*e* are omitted.

The indoor heat exchanger 81*a* has one end thereof connected to the fluid pipe 32 through the indoor expansion valve 82*a* and the other end thereof connected to the flow dividing unit 6*a* described later. The indoor heat exchanger 81*a* functions as an evaporator when the indoor unit 8*a* performs the cooling operation, and functions as a condenser when the indoor unit 8*a* performs the heating operation.

The indoor expansion valve 82*a* has one end thereof connected to the indoor heat exchanger 81*a* and the other end thereof connected to the fluid pipe 32. The indoor expansion valve 82*a* has the opening thereof adjusted according to the required cooling ability when the indoor heat exchanger 81*a* functions as an evaporator, and has the opening thereof adjusted according to the required heating ability when the indoor heat exchanger 81*a* functions as a condenser.

The indoor fan 83*a* is rotated by a non-illustrated fan motor to thereby take indoor air into the indoor unit 8*a*, and after heat exchange between the refrigerant and the indoor air is performed at the indoor heat exchanger 81*a*, the heat-exchanged air is supplied into the room.

In addition to the above-described structure, the indoor unit 8*a* is provided with various sensors. On the pipe on the indoor expansion valve 82*a* side of the indoor heat exchanger 81*a*, a refrigerant temperature sensor 84*a* as the refrigerant temperature detecting means for detecting the temperature of the refrigerant is provided, and on the pipe on the flow dividing unit 6*a* side of the indoor heat exchanger 81*a*, a refrigerant temperature sensor 85*a* that detects the temperature of the refrigerant is provided. In the vicinity of a non-illustrated indoor air inlet of the indoor unit 8*a*, a room temperature sensor 86*a* is provided that detects the temperature of the indoor air flowing into the outdoor unit 2, that is, the room temperature.

The air-conditioning apparatus 1 is provided with the five flow dividing units 6*a* to 6*e* corresponding to the five indoor units 8*a* to 8*e*. The flow dividing units 6*a* to 6*e* are provided with first electromagnetic valves 61*a* to 61*e*, second electromagnetic valves 62*a* to 62*e*, first flow dividing pipes 63*a* to 63*e* and second flow dividing pipes 64*a* to 64*e*. Since the structures of the flow dividing units 6*a* to 6*e* are all the same, in the description given below, only the structure of the flow dividing unit 6*a* will be described, and descriptions of the other flow dividing units 6*b* to 6*e* are omitted.

One end of the first flow dividing pipe 63*a* is connected to the high pressure gas pipe 30, and one end of the second flow dividing pipe 64*a* is connected to the low pressure gas pipe 31. The other end of the first flow dividing pipe 63*a* and the other end of the second flow dividing pipe 64*a* are alternately connected, and this connection and the indoor heat exchanger 81*a* are connected by a refrigerant pipe. The first flow dividing pipe 63*a* is provided with the first electromagnetic valve 61*a*, and the second flow dividing pipe 64*a* is provided with the second electromagnetic valve 62*a*. By opening or closing the first electromagnetic valve 61*a* and the second electromagnetic valve 62*a*, the flow path of the refrigerant in the refrigerant circuit can be switched so that the indoor heat exchanger 81*a* of the indoor unit 8*a* corresponding to the flow dividing unit 6*a* is connected to the discharge side (the side of the high pressure gas pipe 30) or the sucking side (the side of the low pressure gas pipe 31) of the compressor 21.

The condition of connection among the outdoor unit 2, the indoor units 8*a* to 8*e*, the flow dividing units 6*a* to 6*e*, the high pressure gas pipe 30, the low pressure gas pipe 31 and the fluid pipe 32 will be described by using FIG. 1. To the closing valve 42 of the outdoor unit 2, one end of the high pressure gas pipe 30 is connected, and the other end of the high pressure gas pipe 30 branches off to be connected to the first flow dividing pipes 63*a* to 63*e* of the flow dividing units 6*a* to 6*e*. To the closing valve 44 of the outdoor unit 2, one end of the low pressure gas pipe 31 is connected, and the other end of the low pressure gas pipe 31 branches off to be connected to the second flow dividing pipes 64*a* to 64*e* of the flow dividing units 6*a* to 6*e*.

To the closing valve 43 of the outdoor unit 2, one end of the fluid pipe 32 is connected, and the other end of the fluid pipe 32 branches off to be connected to the indoor expansion valves 82*a* to 82*e* of the indoor units 8*a* to 8*e*. The indoor heat exchangers 81*a* to 81*e* side of the indoor units 8*a* to 8*e* are connected to the corresponding flow dividing units 6*a* to 6*e*. The above-described connections constitute the refrigerant circuit of the air-conditioning apparatus 1, and a refrigeration cycle is established by flowing the refrigerant in the refrigerant circuit.

Although not shown, the indoor units 8*a* to 8*e* each have a controller. The controllers of the indoor units 8*a* to 8*e* acquire the detection signals from the sensors of the indoor units 8*a* to 8*e*, and acquire the control signal from a non-illustrated remote controller of the air-conditioning apparatus 1. The controllers of the indoor units 8*a* to 8*e* control the indoor units 8*a* to 8*e* based on the acquired detection signals and control signal. Moreover, the controllers of the indoor units 8*a* to 8*e* open or close the first electromagnetic valves 61*a* to 61*e* and the second electromagnetic valves 62*a* to 62*e* of the corresponding flow dividing units 6*a* to 6*e*, respectively, according to the operation mode (the cooling operation/the heating operation) of the indoor units 8*a* to 8*e*. The controller 100 and the controllers provided in the indoor units 8*a* to 8*e* constitute the control means of the air-conditioning apparatus 1.

Next, the operation of the air-conditioning apparatus 1 in the present embodiment will be described by using FIG. 1. In FIG. 1, the heat exchangers provided in the outdoor unit 2 and the indoor units 8*a* to 8*e* are hatched when they function as condensers, and they are shown without hatched when they function as evaporators. For the open/closed condition of the first electromagnetic valves 61*a* to 61*e* and the second electromagnetic valves 62*a* to 62*e* in the flow dividing units 6*a* to 6*e*, the closed valves are blackened, and the opened valves are shown without blackened. The arrows indicate the flow of the refrigerant.

As shown in FIG. 1, when the air-conditioning apparatus 1 performs the cooling dominant operation, in the outdoor unit 2, as mentioned above, the CPU 110 of the controller 100 makes switching so that the port a and the port b of the first three-way valve 22 communicate and that the port d and the port e of the second three-way valve 23 communicate to use the first outdoor heat exchanger 24 and the second outdoor heat exchanger 25 as condensers.

Of the indoor units 8*a* to 8*e*, in the indoor units 8*a* to 8*c* performing the cooling operation, the controllers close the first electromagnetic valves 61*a* to 61*c* of the corresponding flow dividing units 6*a* to 6*c* to cut off the first flow dividing pipes 63*a* to 63*c*, and open the second electromagnetic valves 62*a* to 62*c* so that the second flow dividing pipes 64*a* to 64*c* communicate. Consequently, the indoor heat exchangers 81*a* to 81*c* of the indoor units 8*a* to 8*c* all function as evaporators. On the other hand, in the indoor units 8*d* and 8*e* performing the heating operation, the controllers open the first electromagnetic valves 61*d* and 61*e* of the corresponding flow dividing units 6*d* and 6*e* so that the first flow dividing pipes 63*d* and 63*e* communicate, and close the second electromagnetic valves 62*d* and 62*e* to cut off the second flow dividing pipes 64*d* and 64*e*. Consequently, the indoor heat exchangers 81*d* and 81*e* of the indoor units 8*d* and 8*e* all function as condensers.

The flow of the high pressure refrigerant discharged from the compressor 21 is split to the side of the first three-way valve 22 and the second three-way valve 23 and the side of the outdoor unit high pressure gas pipe 30*a* at the point P. The high pressure refrigerants having passed through the first three-way valve 22 and the second three-way valve 23 flow into the first outdoor heat exchanger 24 and the second outdoor heat exchanger 25, and undergo heat exchange with outside air to be condensed. The refrigerants condensed by the first outdoor heat exchanger 24 and the second outdoor heat exchanger 25 pass through the first outdoor expansion valve 40 and the second outdoor expansion valve 41 the openings of which are set by the CPU 110 according to the difference between the discharge pressure of the compressor 21 acquired from the high pressure sensor 50 and the fluid pressure acquired from the intermediate pressure sensor 52, become intermediate pressure refrigerants, join together at the connection point Q, and flow into the outdoor unit fluid pipe 32*a*. Then, the refrigerant flows through the fluid pipe 32 by way of the closing valve 43, and is split to flow into the indoor units 8*a* to 8*c*.

The intermediate pressure refrigerants having flown into the indoor units 8*a* to 8*c* are decompressed at the indoor expansion valves 82*a* to 82*c* to be low pressure refrigerants, and are flown into the indoor heat exchangers 81*a* to 81*c*. The low pressure refrigerants having flown into the indoor heat exchangers 81*a* to 81*c* undergo heat exchange with indoor air to be evaporated, thereby cooling the rooms where the indoor units 8*a* to 8*c* are placed. For the indoor expansion valves 82*a* to 82*c*, the controllers of the indoor units 8*a* to 8*c* obtain the refrigerant superheating degree at the indoor heat exchangers 81*a* to 81*c* as evaporators from the refrigerant temperatures acquired from the refrigerant temperature sensors 84*a* to 84*c* and the refrigerant temperatures acquired from the refrigerant temperature sensors 85*a* to 85*c*, and according to this, the openings are determined.

Specifically, when the refrigerant flow amount is small compared to the degree of the cooling ability required by the indoor units 8*a* to 8*c* and the superheating degree of the refrigerant at the outlets of the indoor heat exchangers 81*a* to 81*c* is high accordingly, the controllers of the indoor units 8*a* to 8*c* increase the openings of the indoor expansion valves 82*a* to 82*c* to increase the flow amount of the refrigerant. When the refrigerant flow amount is large compared to the degree of the cooling ability required by the indoor units 8*a* to 8*c* and the superheating degree of the refrigerant at the outlets of the indoor heat exchangers 81*a* to 81*c* is low accordingly, the controllers of the indoor units

8*a* to 8*c* decrease the openings of the indoor expansion valves 82*a* to 82*c* to decrease the flow amount of the refrigerant.

The low pressure refrigerants having flown out from the indoor heat exchangers 81*a* to 81*c* flow into the flow dividing units 6*a* to 6*c*, flow through the second flow dividing pipes 64*a* to 64*c* provided with the second electromagnetic valves 62*a* to 62*c* which are opened, and flow into the low pressure gas pipe 31. Then, the low pressure refrigerants having flown into the low pressure gas pipe 31 from the flow dividing units 6*a* to 6*c* join together in the low pressure gas pipe 31, flow into the outdoor unit 2, and are sucked into the compressor 21 through the accumulator 29 to be compressed again.

On the other hand, the high pressure refrigerant having flown into the high pressure gas pipe 30 through the outdoor unit high pressure gas pipe 30*a* and the closing valve 42 from the connection point P flows into the flow dividing units 6*d* and 6*e*, flows through the first flow dividing pipes 63*d* and 63*e* provided with the first electromagnetic valves 61*d* and 6*e* which are opened, and flows into the indoor units 8*d* and 8*e*. The high pressure refrigerants having flown into the indoor units 8*d* and 8*e* flow into the indoor heat exchangers 81*d* and 81*e*, and undergo heat exchange with indoor air to be condensed, thereby heating the rooms where the indoor units 8*d* and 8*e* are placed. The high pressure refrigerants having flown out from the indoor heat exchangers 81*d* and 81*e* pass through the indoor expansion valves 82*d* and 82*e* to be decompressed into intermediate pressure refrigerants.

For the indoor expansion valves 82*d* and 82*e*, the controllers of the indoor units 8*d* and 8*e* obtain the refrigerant supercooling degree at the indoor heat exchangers 81*d* and 81*e* as condensers from the refrigerant temperatures acquired from the refrigerant temperature sensors 84*d* and 84*e* and the high pressure saturation temperatures (for example, calculated from the pressure detected by the high pressure sensor 50) acquired from the outdoor unit 2, and according to this, the openings are determined.

Specifically, when the refrigerant flow amount is small compared to the degree of the heating ability required by the indoor units 8*d* and 8*e* and the supercooling degree of the refrigerant at the outlets of the indoor heat exchangers 81*d* and 81*e* is high, the controllers of the indoor units 8*d* and 8*e* increase the openings of the indoor expansion valves 82*d* and 82*e* to increase the flow amount of the refrigerant. When the refrigerant flow amount is large compared to the degree of the heating ability required by the indoor units 8*d* and 8*e* and the supercooling degree of the refrigerant at the outlets of the indoor heat exchangers 81*d* and 81*e* is low accordingly, the controllers of the indoor units 8*d* and 8*e* decrease the openings of the indoor expansion valves 82*d* and 82*e* to decrease the flow amount of the refrigerant.

The intermediate pressure refrigerants having flown out from the indoor units 8*d* and 8*e* flow into the fluid pipe 32, join together, and flow into the indoor units 8*a* to 8*c* performing the cooling operation.

Next, a selection method of the outdoor heat exchanger and effects thereof when the outdoor heat exchanger is caused to function as a condenser and the number of outdoor heat exchangers used is one in the outdoor unit 2 of the air-conditioning apparatus 1 of the present embodiment will be described by using FIGS. 3 to 5. In the description given below, as an example, a case will be described in which as the condition of the cooling dominant operation performed by the air-conditioning apparatus 1, as shown in FIG. 3, two indoor units 8*a* and 8*b* are performing the cooling operation, one indoor unit 8*c* is performing the heating operation, the other indoor units 8*d* and 8*e* are not operating and the operating ability required by the two indoor units 8*a* and 8*b* performing the cooling operation is higher than that required by the indoor unit 8*c* performing the heating operation.

Figure 3:
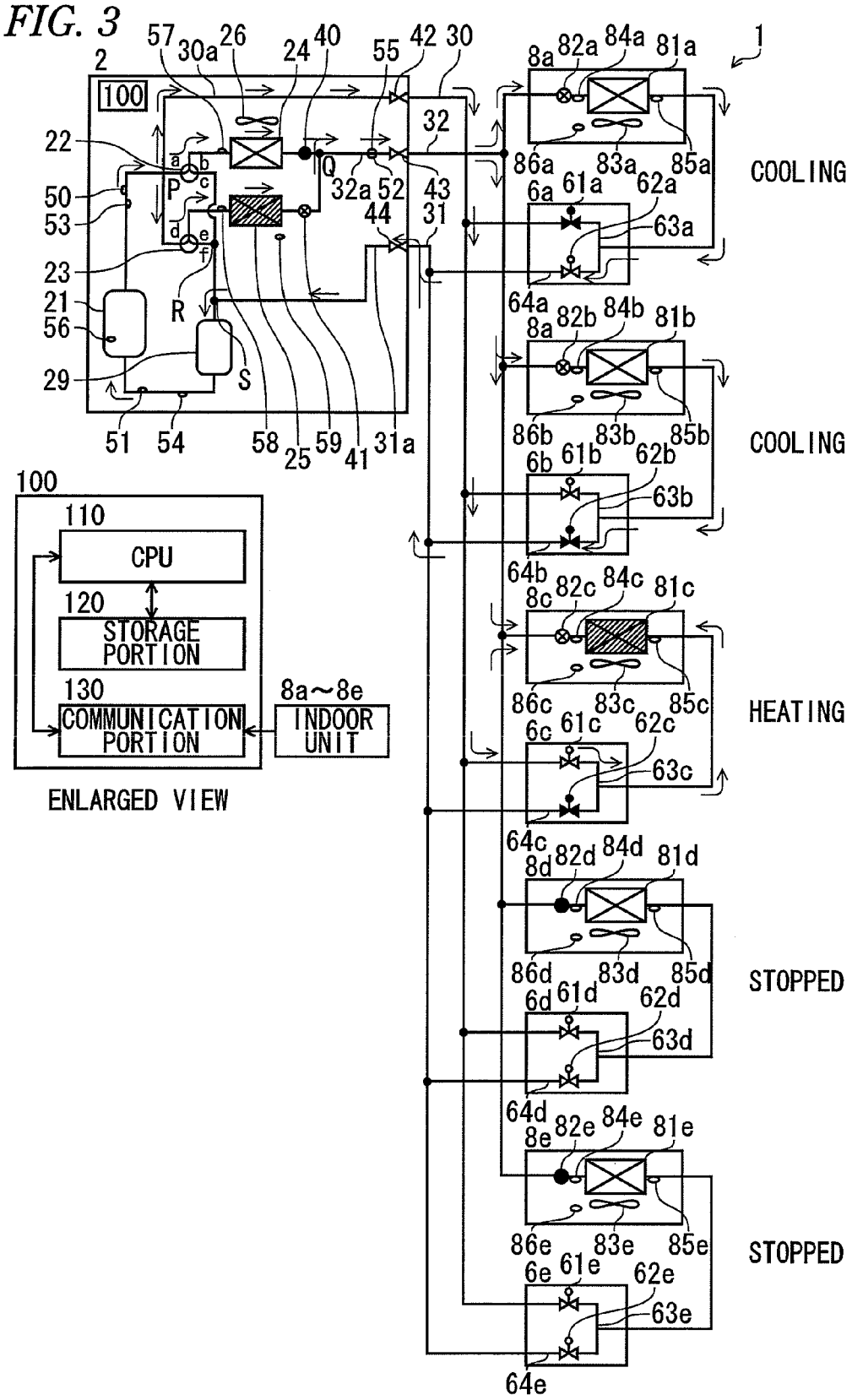
FIG. 3 is a refrigerant circuit diagram when a second outdoor heat exchanger is used as a condenser in the air-conditioning apparatus as the embodiment of the present invention.

In FIG. 3, the structures of the outdoor unit 2, the indoor units 8*a* to 8*e* and the flow dividing units 6*a* to 6*e* and the flow of the refrigerant in the indoor units 8*a* to 8*c*, the flow dividing units 6*a* to 6*c* corresponding thereto and the outdoor unit 2 will not be described since they are the same as those described with reference to FIG. 1. Moreover, the expansions valves which are fully closed are blackened.

The two indoor units 8*a* and 8*b* are placed, for example, in server rooms, and are set so as to perform the cooling operation irrespective of the season by the user (the manager of the server rooms). Therefore, in the flow dividing units 6*a* and 6*b* corresponding to the indoor units 8*a* and 8*b*, the first electromagnetic valves 61*a* and 61*b* are closed and the second electromagnetic valves 62*a* and 62*b* are opened, thereby using the indoor heat exchangers 81*a* and 81*b* as evaporators.

The three indoor units 8*c* to 8*e* are placed in an office, a conference room and the like, and switching between the cooling operation and the heating operation and start/stop of the operation are specified by the user. In the flow dividing unit 6*c* corresponding to the indoor unit 8*c* performing the heating operation, the first electromagnetic valve 61*c* is opened and the second electromagnetic valve 62*c* is closed, thereby using the indoor heat exchanger 81*c* as a condenser. Moreover, in the indoor units 8*d* and 8*e* which are stopped, the indoor expansion valves 82*d* and 82*e* are fully closed.

The CPU 110 of the controller 100 periodically acquires the outside air temperature detected by the outside air temperature sensor 59, and stores it in the storage portion 120. Moreover, the CPU 110 periodically acquires, through the communication portion 130, the temperatures of the refrigerants flowing into the indoor heat exchangers 81*a* and 81*b* used as evaporators which temperatures are detected by the refrigerant temperature sensors 84*a* and 84*b* provided in the indoor units 8*a* and 8*b* (hereinafter, these temperatures will be referred to as inflowing refrigerant temperatures), and stores them in the storage portion 120.

Moreover, when the operating ability required by the two indoor units 8*a* and 8*b* performing the cooling operation is higher than that required by the indoor unit 8*c* performing the heating operation and the outside air temperature is so low that the condensing ability is excessive if two outdoor heat exchangers are used, the CPU 110 performs control so that either one of the first outdoor heat exchanger 24 and the second outdoor heat exchanger 25 is used as a condenser and that the other one is not used.

At this time, the CPU 110 accesses the storage portion 120, extracts the most recent one of the stored outside air temperatures, and extracts the lower one of the most recent stored inflowing refrigerant temperatures of the indoor heat exchangers 81*a* and 81*b* to set this as a first low pressure saturation temperature. Then, the CPU 110 compares the extracted outside air temperature with the first low pressure saturation temperature, and when the outside air temperature is lower than the first low pressure saturation temperature, as shown in FIG. 3, the CPU 110 controls the outdoor unit 2 so that the second outdoor heat exchanger 25 is used as a condenser and that the first outdoor heat exchanger 24 is not used.

Specifically, the CPU 110 makes switching so that the port b and the port c of the first three-way valve 22 communicate, and fully closes the first outdoor expansion valve 40. Consequently, the refrigerant discharged from the compressor 21 does not flow into the first outdoor heat exchanger 24, so that the first outdoor heat exchanger 24 is not used.

Moreover, the CPU 110 makes switching so that the port d and port e of the second three-way valve 23 communicate, and opens the second outdoor expansion valve 41 with a predetermined opening. Consequently, the second outdoor heat exchanger 25 is used as a condenser, and the high temperature and high pressure refrigerant discharged from the compressor 21 flows into the second outdoor heat exchanger 25 to undergo heat exchange with outside air.

For example, when the cooling dominant operation is performed with the refrigerant circuit as shown in FIG. 3, for example, in a case where the outside air temperature is extremely low and lower than the first low pressure saturation temperature as in cold climate areas and in winter mornings and nights, there is a possibility that the refrigerant existing in the first outdoor heat exchanger 24 which is not used is condensed into a fluid refrigerant and accumulates in the first outdoor heat exchanger 24. Consequently, there is a possibility that the refrigerant circulation amount in the refrigerant circuit including the second outdoor heat exchanger 25 which is used is insufficient to decrease the cooling ability.

However, in the outdoor unit 2 of the present embodiment, as described above, the second outdoor heat exchanger 25 disposed below is used as a condenser. Inside the outdoor unit 2, by rotating the outdoor fan 26, the outside air sucked in from the inlets 13*a* to 13*c* undergoes heat exchange with the refrigerant at the second outdoor heat exchanger 25 to be warmed, and is discharged to the outside from the outlet 11. At this time, as shown by the arrows B in FIG. 5, the heat generated at the second outdoor heat exchanger 25 circulates to the first outdoor heat exchanger 24.

The heat generated at the second outdoor heat exchanger 25 circulates to the first outdoor heat exchanger 24, and undergoes heat exchange with the fluid refrigerant accumulating inside the first outdoor heat exchanger 24, so that the accumulating fluid refrigerant evaporates into a gas refrigerant and is sucked into the compressor 21. Consequently, since the fluid refrigerant can be prevented from accumulating inside the first outdoor heat exchanger 24, the accumulation amount of the refrigerant at the first outdoor heat exchanger 24 can be reduced, so that the refrigerant circulation amount in the refrigerant circuit of the air-conditioning apparatus 1 including the second outdoor heat exchanger 25 which is used can be prevented from being insufficient.

Figure 4:
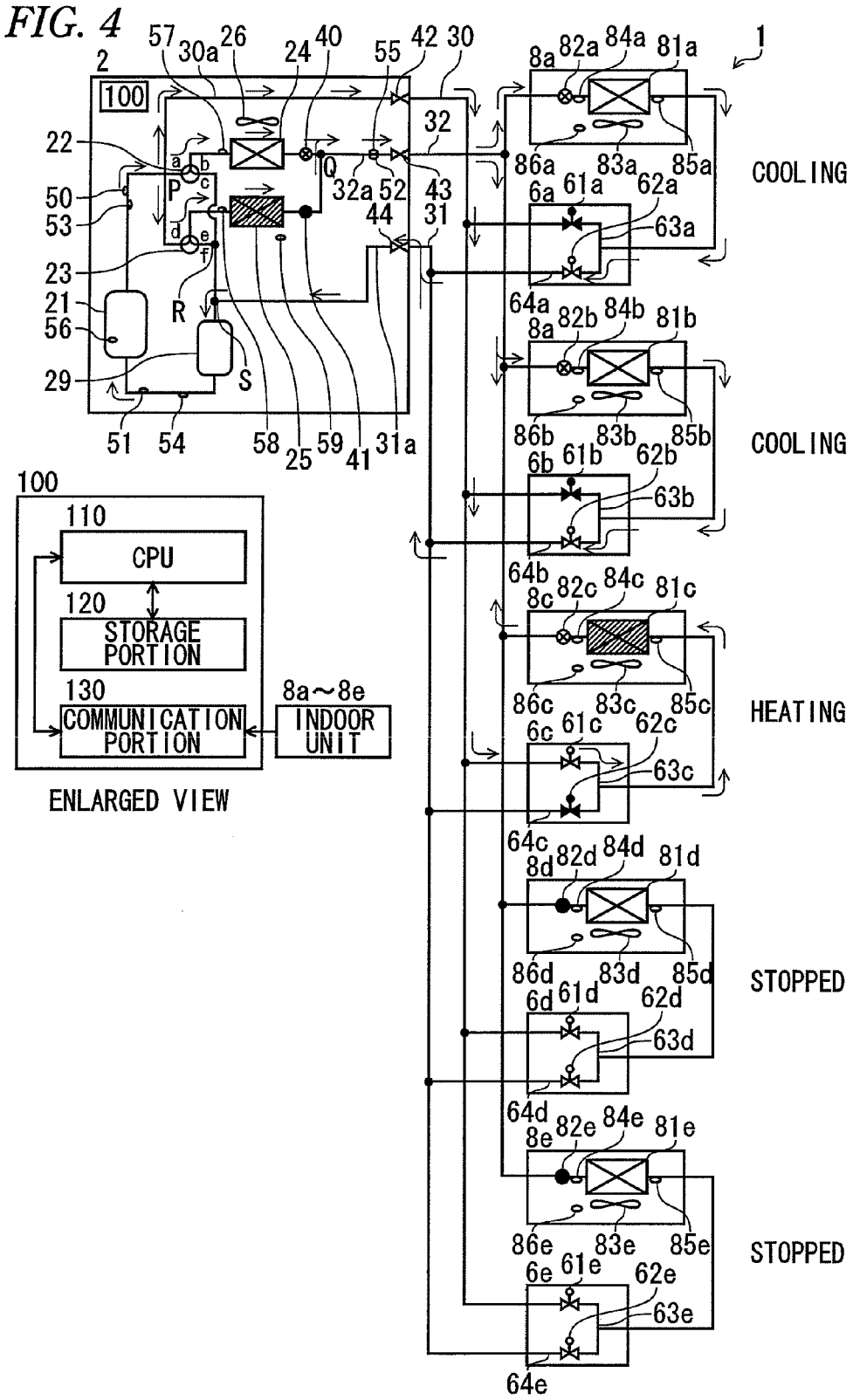
FIG. 4 is a refrigerant circuit diagram when a first outdoor heat exchanger is used as a condenser in the air-conditioning apparatus as the embodiment of the present invention.

On the other hand, when the outside air temperature is higher than the second low pressure saturation temperature which is higher than the first low pressure saturation temperature by a predetermined temperature, for example, five degrees C., as shown in FIG. 4, the CPU 110 controls the outdoor unit 2 so that the first outdoor heat exchanger 24 is used as a condenser and that the second outdoor heat exchanger 25 is not used.

Specifically, the CPU 110 makes switching so that the port a and port b of the first three-way valve 22 communicate, and opens the first outdoor expansion valve 40 with a predetermined opening. Consequently, the first outdoor heat exchanger 24 is used as a condenser, and the high temperature and high pressure refrigerant discharged from the compressor 21 flows into the first outdoor heat exchanger 24 and undergoes heat exchange with outside air.

Moreover, the CPU 110 makes switching so that the port e and the port f of the second three-way valve 23 communicate, and fully closes the second outdoor expansion valve. Consequently, the refrigerant discharged from the compressor 21 does not flow into the second outdoor heat exchanger 25, so that the second outdoor heat exchanger 25 is not used.

When the outside air temperature is higher than the second low pressure saturation temperature, the possibility is high that the refrigerant existing in the outdoor heat exchanger which is not used is condensed into a fluid refrigerant and the refrigerant is accumulating in the unused outdoor heat exchanger to make the refrigerant circulation amount in the refrigerant circuit insufficient. In such a case, as shown in FIGS. 2A and 5, by using as a condenser the first outdoor heat exchanger 24 placed in a position near the outdoor fan 26 and where the outside air sucked into the outdoor unit 2 from the inlets 13*a* to 13*c* by the rotation of the outdoor fan 26 flows more than in the second outdoor heat exchanger 25, the heat exchange between the refrigerant flowing through the first outdoor heat exchanger 24 and the outside air is performed more efficiently than when the second outdoor heat exchanger 25 is used as a condenser, so that the efficiency of the cooling dominant operation performed by the air-conditioning apparatus 1 improves.

In the switching between the first outdoor heat exchanger 24 and the second outdoor heat exchanger 25, the low pressure saturation temperature compared with the outside air temperature is divided into the first low pressure saturation temperature and the second low pressure saturation temperature for the following reason: When the difference between the outside air temperature and the low pressure saturation temperature is small, there is a possibility that the condition where the outside air temperature is higher than the low pressure saturation temperature and the condition where it is lower frequently change places. If the switching between the first outdoor heat exchanger 24 and the second outdoor heat exchanger 25 is made under such a condition according to whether the outside air temperature is higher than the same low pressure saturation temperature value or not, there is a possibility that switching between the first outdoor heat exchanger 24 and the second outdoor heat exchanger 25 occurs frequently. Therefore, by making different the first low pressure saturation temperature compared with the outside air temperature when switching from the first outdoor heat exchanger 24 to the second outdoor heat exchanger 25 is made and the second low pressure saturation temperature compared with the outside air temperature when switching from the second outdoor heat exchanger 25 to the first outdoor heat exchanger 24 is made as in the present embodiment, switching between the first outdoor heat exchanger 24 and the second outdoor heat exchanger 25 can be prevented from occurring frequently.

While a case where two outdoor heat exchangers are provided in the outdoor unit 2 has been described an example in the above-described embodiment, three or more outdoor heat exchangers may be provided. For example, in a case where three outdoor heat exchangers are connected in parallel by refrigerant pipes and the three heat exchangers are placed one above another in the vertical direction below the outdoor fan 26, when the outside air temperature is lower than the first low pressure saturation temperature, only the lower or the lower and middle heat exchangers are used as condensers according to the required operating ability. When the outside air temperature is higher than the second low pressure saturation temperature, only the upper or the upper and middle outdoor heat exchangers are used as condensers according to the required operating ability.

Figure 5:
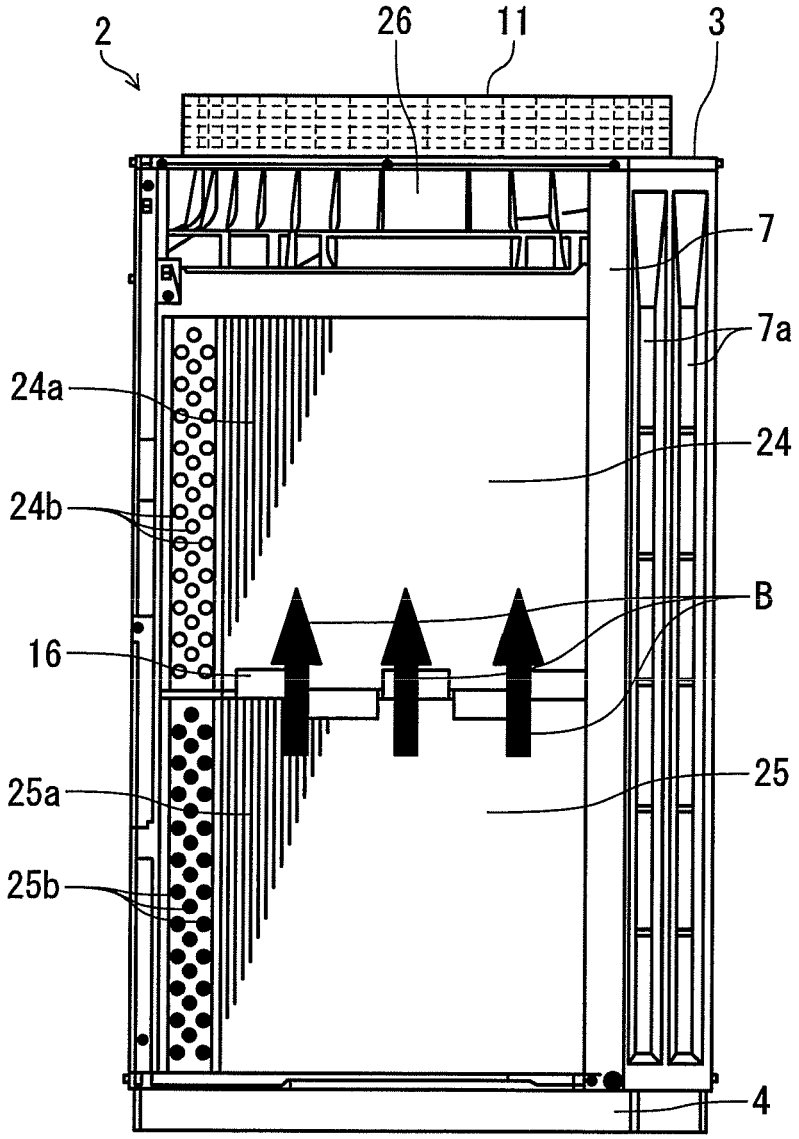
FIG. 5 is a schematic view, of the outdoor unit of FIG. 2 viewed from the front, explaining the effects when the second outdoor heat exchanger is used as a condenser.

In a case where four outdoor heat exchangers are provided and the heat exchangers are disposed in two rows each consisting of two on the right and left of or in front of and behind the outdoor unit 2 under a condition where they are placed one on another in the vertical direction as shown in FIGS. 2A and 5, when the outside air temperature is lower than the first low pressure saturation temperature, one or both of the lower outdoor heat exchangers in the rows are used as condensers according to the required operating ability. When the outside air temperature is higher than the second low pressure saturation temperature, one or both of the upper outdoor heat exchangers in the rows are used as condensers according to the required operating ability.

Moreover, instead of a plurality of outdoor heat exchangers, an outdoor heat exchanger having a plurality of fins and a plurality of independent refrigerant circuits may be provided in the outdoor unit 2. For example, in an outdoor heat exchanger having a common fin and two independent refrigerant circuits formed of a copper pipe 24*b* and a copper pipe 25*b* instead of the first outdoor heat exchanger 24 and the second outdoor heat exchanger 25 in FIGS. 1 to 5, in a case where it is necessary to flow the refrigerant through only one of the copper pipes, when the outside air temperature is lower than the first low pressure saturation temperature, the lower copper pipe is used. When the outside air temperature is higher than the second low pressure saturation temperature, the upper copper pipe is used.

Figure 6:
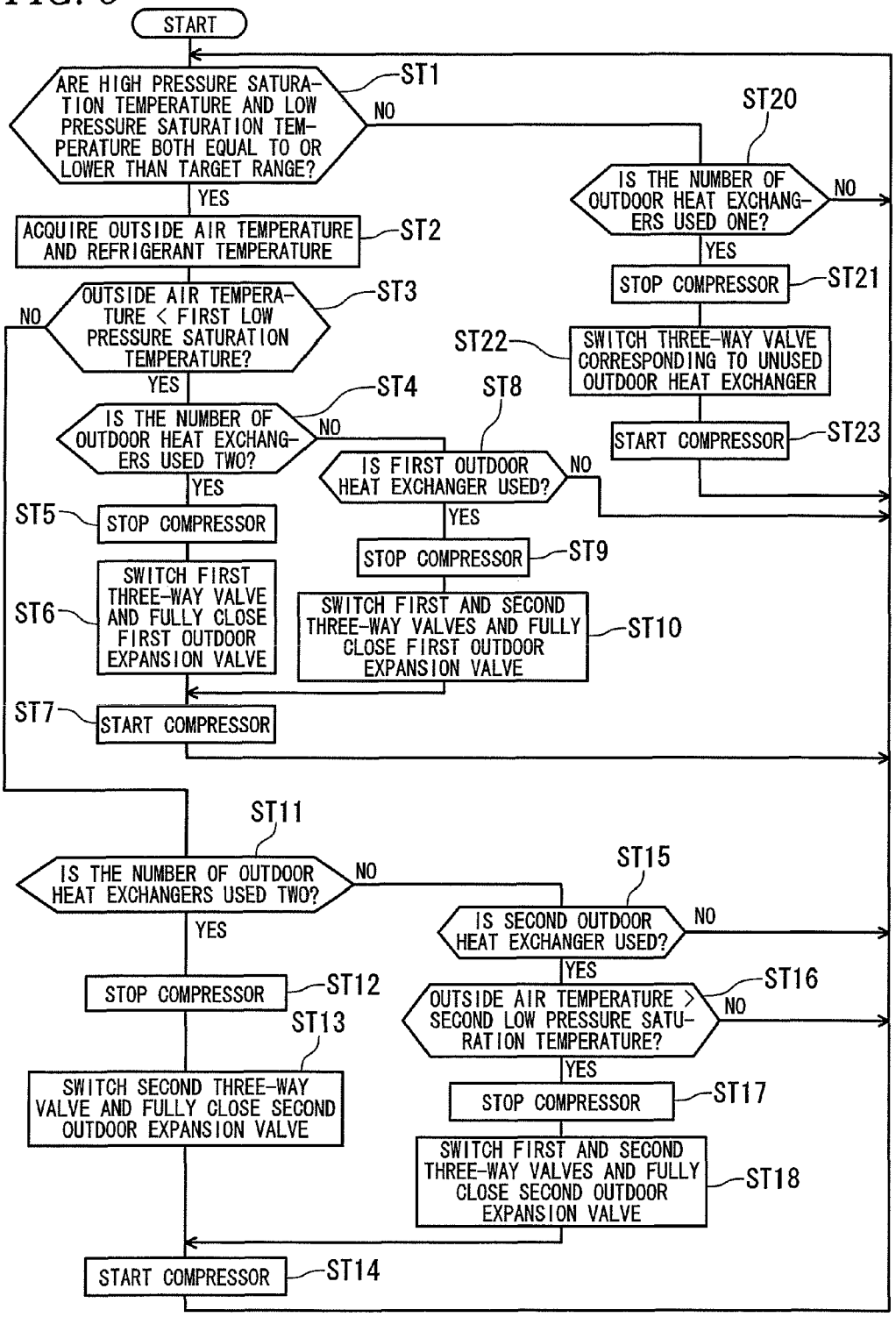
FIG. 6 is a flowchart explaining switching control of the outdoor heat exchangers in the air-conditioning apparatus as the embodiment of the present invention.

Next, the flow of the processing of the air-conditioning apparatus 1 in the present embodiment will be described by using the flowcharts shown in FIG. 6. The flowcharts shown in FIG. 6 shows the flow of the processing related to the switching between the outdoor heat exchangers by the CPU 110 when the air-conditioning apparatus 1 is performing the cooling dominant operation. ST represents a step, and the number following this represents a step number. FIG. 6 mainly explains the processing related to the present invention, and descriptions are omitted of general operations of the refrigerant circuit such as the control of the number of rotations of the compressor 21 according to operation conditions such as the set temperature and the air amount specified by the user, and switching/opening control of various valves.

Receiving an operation instruction from the user, the air-conditioning apparatus 1 starts operating, and performs the cooling dominant operation described by using FIG. 3. The CPU 110 acquires the pressure detected by the high pressure sensor 50 and calculates the high pressure saturation temperature from this pressure, and acquires the pressure detected by the low pressure sensor 51 and calculates the low pressure saturation temperature from this pressure. In the air-conditioning apparatus 1 according to the present embodiment, the range of the high pressure saturation temperature as the control target and the range of the low pressure saturation temperature as the control target are individually preset according to the structure of the air-conditioning apparatus 1 (the number of mounted outdoor heat exchangers and the number of indoor units connected to the outdoor unit), and are stored in the storage portion 120. In a case where the outdoor heat exchangers are caused to function as condensers, when the high pressure saturation temperature and the low pressure saturation temperature are both equal to or lower than the target range, in order to increase both the high pressure saturation temperature and the low pressure saturation temperature to the target range, the number of outdoor heat exchangers used is reduced to reduce the condensing ability. On the other hand, when the high pressure saturation temperature and the low pressure saturation temperature are both equal to or higher than the target range, in order to reduce both the high pressure saturation temperature and the low pressure saturation temperature to the target range, the number of outdoor heat exchangers used is increased to increase the condensing ability.

The CPU 110 determines whether the high pressure saturation temperature and the low pressure saturation temperature are both equal to or lower than the target range or not (ST1). When neither the high pressure saturation temperature nor the low pressure saturation temperature is equal to or lower than the target range (ST1—No), the CPU 110 determines whether the number of currently used outdoor heat exchangers is one or not (ST20). When the number of currently used outdoor heat exchangers is not one, that is, when it is two (ST20—NO), the CPU 110 returns the process to ST1.

When the number of currently used outdoor heat exchangers is one (ST20—Yes), the CPU 110 stops the compressor 21 (ST21), and switches the three-way valve corresponding to the unused outdoor heat exchanger so that the compressor 21 and the outdoor heat exchanger communicate (ST22). Then, the CPU 110 starts the compressor 21 (ST23), controls the first outdoor expansion valve and the second outdoor expansion valve so as to have a predetermined opening, and performs the cooling dominant operation. The CPU 110 having finished the operation returns the process to ST1.

At ST1, when the high pressure saturation temperature and the low pressure saturation temperature are both equal to or lower than the target range (ST1—Yes), the CPU 110 accesses the storage portion 120, extracts the most recent outside air temperature and the lower one of the most recent inflowing refrigerant temperatures (ST2), and sets the extracted inflowing refrigerant temperature as the first low pressure saturation temperature.

Then, the CPU 110 determines whether the extracted outside air temperature is lower than the first low pressure saturation temperature or not (ST3). When the outside air temperature is lower than the first low pressure saturation temperature (ST3—Yes), the CPU 110 determines whether the number of currently used outdoor heat exchangers is two or not (ST4).

When the number of currently used outdoor heat exchangers is two (ST4—Yes), the CPU 110 stops the compressor 21 (ST5), switches the first three-way valve 22 to cut off the communication between the outlet of the compressor 21 and the first outdoor heat exchanger 24, and fully closes the first outdoor expansion valve 40 (ST6). Then, the CPU 110 starts the compressor 21 (ST7), controls the second outdoor expansion valve 41 so as to have a predetermined opening, and performs the cooling dominant operation. The CPU 110 having finished the processing of ST7 returns the process to ST1.

At ST4, when the number of currently used outdoor heat exchangers is not two, that is, when either one of the outdoor heat exchangers is used (ST4—No), the CPU 110 determines whether the outdoor heat exchanger used is the first outdoor heat exchanger 24 or not (ST8). When the outdoor heat exchanger used is not the first outdoor heat exchanger 24 (ST8—No), that is, when the outdoor heat exchanger used is the second outdoor heat exchanger 25, the CPU 110 returns the process to ST1.

When the outdoor heat exchanger used is the first outdoor heat exchanger 24 (ST8—Yes), the CPU 110 stops the compressor 21 (ST9), switches the first three-way valve 22 to cut off the communication between the outlet of the compressor 21 and the first outdoor heat exchanger 24, switches the second three-way valve 23 so that the outlet of the compressor 21 and the second outdoor heat exchanger 25 communicate, and fully closes the first outdoor expansion valve 40 (ST10). Then, the CPU 110 advances the process to ST7.

On the other hand, at ST3, when the outside air temperature is higher than the first low pressure saturation temperature (ST3—No), the CPU 110 determines whether the number of currently used outdoor heat exchangers is two or not (ST11). When the number of currently used outdoor heat exchangers is two (ST11—Yes), the CPU 110 stops the compressor 21 (ST12), switches the second three-way valve 23 to cut off the communication between the outlet of the compressor 21 and the second outdoor heat exchanger 25, and fully closes the second outdoor expansion valve 41 (ST13). Then, the CPU 110 starts the compressor 21 (ST14), controls the first outdoor expansion valve 40 so as to have a predetermined opening, and performs the cooling dominant operation. The CPU 110 having finished the processing of ST14 returns the process to ST1.

At ST11, when the number of currently used outdoor heat exchangers is not two, that is, when either one of the outdoor heat exchangers is used (ST11—No), the CPU 110 determines whether the outdoor heat exchanger used is the second outdoor heat exchanger 25 or not (ST15). When the outdoor heat exchanger used is not the second outdoor heat exchanger 25 (ST15—No), that is, when the outdoor heat exchanger used is the first outdoor heat exchanger 24, the CPU 110 returns the process to ST1.

When the outdoor heat exchanger used is the second outdoor heat exchanger 25 (ST15—Yes), the CPU 110 determines whether or not the extracted outside air temperature is higher than the second low pressure saturation temperature which is the first low pressure saturation temperature to which a predetermined temperature is added (ST16).

When the outside air temperature is lower than the second low pressure saturation temperature (ST16—No), the CPU 110 returns the process to ST1. When the outside air temperature is higher than the second low pressure saturation temperature (St16—Yes), the CPU 110 stops the compressor 21 (ST17), switches the first three-way valve 22 so that the outlet of the compressor 21 and the first outdoor heat exchanger 24 communicate, switches the second three-way valve 23 to cut off the communication between the outlet of the compressor 21 and the second outdoor heat exchanger 25, and fully closes the second outdoor expansion valve 41 (ST18). Then, the CPU 110 advances the process to ST14.

As described above, in the air-conditioning apparatus of the above embodiments, when outdoor heat exchangers are caused to function as condensers and some of a plurality of outdoor heat exchangers are selectively used, the outdoor heat exchangers to be used are selected according to the relationship between the acquired outside air temperature and the first low pressure saturation temperature. Thereby, the fluid refrigerant is prevented from accumulating in the unused outdoor heat exchangers and this prevents the reduction in the refrigerant circulation amount in the refrigerant circuit including the outdoor heat exchangers used, and by using the outdoor heat exchanger near the outdoor fan as much as possible, the heat exchange efficiency at the outdoor heat exchangers can be improved.

What is claimed is:

1. An air-conditioning apparatus comprising:

an outdoor unit including: a compressor; a plurality of outdoor heat exchangers; flow path switching means connected to one end of each of the outdoor heat exchangers and switching connection to a refrigerant outlet or a refrigerant inlet of the compressor; opening and closing means connected to another end of each of the outdoor heat exchangers; an outdoor fan; and outside air temperature detecting means for detecting an outside air temperature;

a plurality of indoor units including an indoor heat exchanger and refrigerant temperature detecting means for detecting a temperature of a refrigerant flowing into or flowing out from the indoor heat exchanger; and control means for controlling the outdoor unit and the indoor units, wherein the outdoor fan is disposed in an upper part of a housing of the outdoor unit, the housing of the outdoor unit has an inlet for taking outside air into the housing by a rotation of the outdoor fan, the outdoor heat exchangers are disposed one above another so as to face the inlet, the control means acquires the outside air temperature detected by the outside air temperature detecting means, and acquires, as a first low pressure saturation temperature, the refrigerant temperature detected by the refrigerant temperature detecting means corresponding to the indoor heat exchanger used as an evaporator, and the control means causes the outdoor heat exchangers to function as condensers, and in a case where some of the outdoor heat exchangers are selectively used, when the outside air temperature is lower than the first low pressure saturation temperature, the control means selects for use the outdoor heat exchanger disposed below, and when the outside air temperature is higher than the first low pressure saturation temperature, the control means selects for use the outdoor heat exchanger disposed above, wherein the outdoor heat exchanger disposed below is relatively farther from the outdoor fan than the outdoor heat exchanger disposed above, wherein, when the outdoor heat exchanger disposed below is selected to function as the condenser, the outdoor heat exchanger disposed below is positioned to circulate heat to the outdoor heat exchanger disposed above.

2. The air-conditioning apparatus according to claim 1, wherein the outdoor unit has low pressure detecting means for detecting a pressure of the refrigerant sucked into the compressor, and the control means calculates the first low pressure saturation temperature from the pressure of the refrigerant detected by the low pressure detecting means.

3. The air-conditioning apparatus according to claim 1, wherein when the outside air temperature is higher than a second low pressure saturation temperature which is the first low pressure saturation temperature to which a predetermined temperature is added, the control means selects for use the outdoor heat exchanger disposed above.

4. The air-conditioning apparatus according to claim 2, wherein when the outside air temperature is higher than a second low pressure saturation temperature which is the first low pressure saturation temperature to which a predetermined temperature is added, the control means selects for use the outdoor heat exchanger disposed above.

5. An air-conditioning apparatus comprising:

an outdoor unit disposed inside a housing, wherein the outdoor unit includes a compressor, an upper outdoor heat exchanger, a lower outdoor heat exchanger, an outside air temperature sensor configured to detect an outside air temperature, and the housing having an outdoor fan disposed at a first side of the housing and an inlet for receiving outside air at a second side of the housing;

an indoor unit including an indoor heat exchanger used as an evaporator and a refrigerant temperature sensor configured to detect a temperature of a refrigerant flowing into or out from the indoor heat exchanger; and a controller configured to acquire the outside air temperature detected by the outside air temperature sensor and a first low pressure saturation temperature detected by the refrigerant temperature sensor;

wherein the controller selects the upper outdoor heat exchanger or the lower outdoor heat exchanger to function as a condenser based on a relationship between the outside air temperature and the first low pressure saturation temperature, wherein the upper outdoor heat exchanger is disposed inside the housing relatively closer to the outdoor fan than the lower outdoor heat exchanger, wherein the upper outdoor heat exchanger is disposed above the lower outdoor heat exchanger, wherein the first side of the housing is the top of the housing, wherein the second side of the housing extends in a direction between the top of the housing and a bottom of the housing, and the upper outdoor heat exchanger is disposed on top of the lower outdoor heat exchanger in the direction of the second side of the housing, wherein the controller is configured to select the lower outdoor heat exchanger to function as the condenser when the outside air temperature is lower than the first low pressure saturation temperature, wherein, when the lower outdoor heat exchanger is selected to function as the condenser, the lower outdoor heat exchanger is positioned to circulate heat generated with the condenser function to the upper outdoor heat exchanger.

6. The air-conditioning apparatus according to claim 5, wherein the outdoor fan is positioned to suck air into the inlet of the housing such that the air is warmed by the lower outdoor heat exchanger selected to function as the condenser and circulated to the upper outdoor heat exchanger.

7. The air-conditioning apparatus according to claim 5, wherein the controller is configured to select the upper outdoor heat exchanger to function as the condenser when the outside air temperature is higher than the first low pressure saturation temperature.

8. The air-conditioning apparatus according to claim 7, wherein, when the upper outdoor heat exchanger or the lower outdoor heat exchanger is selected to function as the condenser, the controller is configured to allow refrigerant to flow to the selected outdoor heat exchanger.

9. The air-conditioning apparatus according to claim 8, wherein the controller is configured to stop refrigerant flow to the outdoor heat exchanger not selected to function as the condenser.

10. The air-conditioning apparatus according to claim 7, wherein the controller is configured to acquire a second low pressure saturation temperature, the second low pressure saturation temperature being the first low pressure saturation temperature to which a predetermined temperature is added;

wherein the controller is configured to select the upper outdoor heat exchanger to function as a condenser when the outside air temperature is higher than the second low pressure saturation temperature.

11. The air-conditioning apparatus according to claim 10, the outdoor unit further comprising a pressure sensor configured to detect a pressure of refrigerant sucked into the compressor;

wherein the controller is configured to calculate the first low pressure saturation temperature based on the detected pressure of refrigerant sucked into the compressor.

12. The air-conditioning apparatus according to claim 5, wherein the controller is configured to periodically acquire and store the outside air temperature and the first low pressure saturation temperature, extract the stored outside air temperature and the first low pressure saturation temperature, and compare the stored outside air temperature and the first low pressure saturation temperature.

* * * * *